US012012823B2

(12) United States Patent
Neacsu et al.

(10) Patent No.: US 12,012,823 B2
(45) Date of Patent: Jun. 18, 2024

(54) CEMENT RETAINER FOR REMEDIAL OPERATIONS

(71) Applicant: Saudi Arabian Oil Company, Dhahran (SA)

(72) Inventors: Marius Neacsu, Dhahran (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 105 days.

(21) Appl. No.: 17/705,101

(22) Filed: Mar. 25, 2022

(65) Prior Publication Data

US 2023/0304375 A1 Sep. 28, 2023

(51) Int. Cl.

| | |
|---|---|
| ***E21B 33/14*** | (2006.01) |
| ***E21B 34/12*** | (2006.01) |
| ***E21B 34/14*** | (2006.01) |

(52) U.S. Cl.

CPC ..... *E21B 33/14* (2013.01); *E21B 34/14* (2013.01); *E21B 2200/05* (2020.05); *E21B 2200/06* (2020.05)

(58) Field of Classification Search

CPC ..... E21B 33/13; E21B 33/14; E21B 34/12; E21B 2200/05

See application file for complete search history.

(56) References Cited

U.S. PATENT DOCUMENTS

| | | | | |
|---|---|---|---|---|
| 4,478,286 | A | 10/1984 | Fineberg | |
| 7,255,178 | B2 | 8/2007 | Slup et al. | |
| 8,424,611 | B2 | 4/2013 | Smith et al. | |
| 9,328,585 | B2 | 5/2016 | Groesbeck et al. | |
| 9,637,977 | B2 | 5/2017 | Giroux et al. | |
| 10,119,359 | B2 * | 11/2018 | Frazier | E21B 43/26 |
| 2018/0334884 | A1 * | 11/2018 | Jenkins | E21B 33/14 |

FOREIGN PATENT DOCUMENTS

| | | |
|---|---|---|
| CA | 1329349 | 5/1994 |

* cited by examiner

*Primary Examiner* — Catherine Loikith
(74) *Attorney, Agent, or Firm* — Fish & Richardson P.C.

(57) ABSTRACT

A wellbore assembly includes a wellbore string and a cement retainer. The wellbore string is disposed within a cased wellbore. The cement retainer is releasably coupled to the wellbore string and defines, with a wall of the casing, an annulus. The cement retainer includes a housing, a valve, and a packer. The flapper valve is attached to and disposed within the bore of the housing. The flapper valve moves between a closed position, in which a fluid pathway of the cement retainer is closed, and an opened position, in which the fluid pathway is opened for fluid to flow downhole out of the cement retainer. The wellbore string opens, with the packer set on the wellbore, the flapper valve by stinging the flapper valve and allowing cement to flow downhole from the wellbore string to the target zone to remediate the wellbore at the target zone.

20 Claims, 5 Drawing Sheets

CEMENT RETAINER FOR REMEDIAL OPERATIONS

FIELD OF THE DISCLOSURE

This disclosure relates to wellbore operations, and more particularly to remedial cementing operations.

BACKGROUND OF THE DISCLOSURE

Remedial cementing operations are a type of cementing operation typically performed to repair primary-cementing problems or to address wellbore problems after the wellbore has been constructed. The process of performing remedial cementing operations can be lengthy and present multiple challenges. Methods and equipment for improving cementing operations are sought.

SUMMARY

Implementations of the present disclosure include a wellbore assembly that includes a wellbore string and a cement retainer. The wellbore string is disposed within a wellbore comprising a casing. The wellbore string flows fluid from or near a terranean surface of the wellbore to a target zone of the wellbore at a downhole location of the wellbore. The cement retainer is releasably coupled to the wellbore string and resides at a downhole end of the wellbore string. The cement retainer defines, with a wall of the casing, an annulus. The cement retainer includes a housing, a valve, and a packer. The cement retainer defines a bore fluidly coupled to the wellbore string. The flapper valve is attached to and disposed within the bore of the housing. The flapper valve moves between a closed position, in which a fluid pathway of the cement retainer is closed by the flapper valve, and an opened position, in which the fluid pathway is opened for fluid to flow downhole past the flapper valve and out of the cement retainer. The packer is attached to the housing. The packer fluidly isolates, with the packer set on the wellbore, a first section of the annulus uphole of the packer from a second section of the annulus at the target zone and downhole of the packer. The wellbore string sets the packer on the casing. The wellbore string opens, with the packer set on the wellbore and the wellbore string detached from the wellbore string, the flapper valve by stinging the flapper valve and allowing cement to flow downhole from the wellbore string to the target zone to remediate the wellbore at the target zone.

In some implementations, the wellbore string comprises a ring fixed to the wellbore string and defines, with an inner rim of the cement retainer, a no-go profile. The inner rim bears against and prevents the ring from moving downhole past the inner rim.

In some implementations, the housing includes a tubular housing defining the bore and a flapper valve housing threadedly coupled to a downhole end of the tubular housing. The flapper valve housing defines a second bore that defies a diameter less than a diameter of the bore of the tubular housing. The flapper valve resides inside the flapper valve housing. The flapper valve defines the inner rim and the fluid outlet of the housing. In some implementations, the ring is disposed at a distance from a downhole fluid outlet of the wellbore string such that, with the wellbore string stinging the flapper valve, the ring bears against the inner rim and the downhole fluid outlet extends a distance downhole from a pivot of the flapper valve with the valve fully opened.

In some implementations, the wellbore assembly performs a remedial cement squeeze operation and the target zone includes at least one of a damaged section of the casing, a perforated section of the casing, an open hole section of the wellbore, or a defective cement layer of the casing.

In some implementations, the target zone includes an isolated section defined between a wellbore plug downhole of the cement retainer and the packer set on the casing. The wellbore string flows fluid into the isolated section and squeezes, under fluidic pressure, cement out of the casing through an aperture of the casing into a second annulus defined between the casing and a wall of the wellbore.

In some implementations, the wellbore string mechanically sets, with the flapper valve closed and the wellbore string attached to the cement retainer, the packer on the wellbore.

In some implementations, the flapper valve includes a spring that biases the flapper valve to the closed position to restrict fluid from flowing uphole along the fluid pathway.

In some implementations, the cement retainer is releasably coupled to the wellbore string by one or more shear pins extending from the wellbore string to the bore of the cement retainer. The shear pins collapse under a shear force applied, with the packer set on the casing, by the wellbore string pushed downhole from the terranean surface of the wellbore.

In some implementations, the packer retracts from the casing and the wellbore string engages, after cement has been flown to the target zone, the cement retainer to pull, with the packer unset from the casing, the cement retainer out of the wellbore.

In some implementations, the cement retainer is drillable by a drill string. The packer remains set on the casing during curing of the cement.

Implementations of the present disclosure include a cement retainer that includes a housing, a valve, and a packer. The housing is releasably coupled to and resides at a downhole end of a wellbore string. The wellbore string is arranged to be disposed within a wellbore including a casing. The housing defines a bore fluidly coupled to the wellbore string and defining a fluid pathway extending from a fluid inlet of the cement retainer to a fluid outlet of the cement retainer. The wellbore defines, between an external surface of the housing and a wall of the casing, an annulus. The valve is attached to and resides inside the housing. The valve restricts fluid from flowing uphole along the fluid pathway. The valve is pivotable about a pivot and includes a spring configured to bias the valve about the pivot to a closed position, in which the valve blocks the fluid pathway and prevents fluid from flowing downhole along the fluid pathway. The valve is movable to an opened position, in which the fluid pathway is opened and the valve allows fluid to flow downhole along the fluid pathway. The packer is attached to the housing. The packer isolates, with the packer set on the wall of the casing, a first section of the annulus uphole of the packer from a target zone of the wellbore downhole of the packer. The valve is opened, with the packer set on the casing, by the wellbore string stinging the valve, allowing cement to flow from the wellbore string to the target zone to remediate the wellbore at the target zone.

In some implementations, the cement retainer is configured to perform a remedial cement squeeze operation and the target zone includes at least one of a damaged section of the casing, a perforated section of the casing, an open hole section of the wellbore, or a defective cement layer of the casing. In some implementations, the target zone includes an isolated section defined between a bottom hole end of the wellbore or a wellbore plug and the packer. The wellbore string flows fluid into the isolated section and squeezes, under fluidic pressure, cement out of the casing through an aperture of the casing into a second annulus defined between the casing and a wall of the wellbore.

In some implementations, the housing is releasably coupled to the wellbore string by one or more shear pins extending from the wellbore string to the bore of the housing. The one or more shear pins collapse under a shear force applied, with the packer set on the casing, by the wellbore string pushed downhole with respect to the cement retainer.

In some implementations, the wellbore string includes an outwardly-projecting shoulder fixed to the wellbore string and defining, with an inner rim of the cement retainer, a no-go profile in which the inner rim bears against and prevent the outwardly-projecting shoulder from moving downhole past the inner rim.

In some implementations, the housing includes a tubular housing that defines the bore and a flapper valve housing attached to a downhole end of the tubular housing. The flapper valve housing defines a second bore defining a diameter less than a diameter of the bore. The flapper valve resides inside the flapper valve housing and defines the inner rim and the fluid outlet of the housing. In some implementations, the outwardly-projecting shoulder is disposed at a distance from a downhole fluid outlet of the wellbore string such that, during stinging of the flapper valve, the outwardly-projecting shoulder bears against the inner rim and the downhole fluid outlet extends a distance downhole from a pivot of the flapper valve with the flapper valve fully opened.

Implementations of the present disclosure include a method of performing a remedial cementing operation. The method includes lowering, with a tubing string, a cement retainer to a target zone of a wellbore including a casing. The cement retainer is releasably and fluidly coupled to a downhole section of the wellbore string. The cement retainer includes a bore defining a fluid pathway extending from a fluid inlet of the cement retainer to a fluid outlet of the cement retainer. The wellbore defines, between an external surface of the cement retainer and a wall of the casing, an annulus. The cement retainer includes i) a valve residing at the bore and configured to restrict fluid from flowing uphole along the fluid pathway, the valve being pivotable between a closed position, in which the valve blocks the fluid pathway, and an opened position, in which the fluid pathway is opened and the valve allows fluid to flow downhole along the fluid pathway; and ii) a packer that isolates, with the packer set on the wall of the casing, a first section of the annulus uphole of the packer from the target zone of the wellbore, the target zone of the wellbore being downhole of the packer. The method also includes setting the packer on the wall of the wellbore. The method also includes stinging, with the tubing string, the cement retainer, opening the valve. The method also includes flowing, with the tubing string extending past the valve and maintaining the valve open, cement from the tubing string to the target zone to remediate the wellbore at the target zone.

In some implementations, the method further includes retrieving the tubing string and, after the cement has cured, drilling the cement retainer and continuing to drill past the cement retainer through the cured cement.

DETAILED DESCRIPTION OF THE DISCLOSURE

The present disclosure relates to methods and equipment for performing remedial cementing operations (e.g., squeeze cement operations) in a wellbore. Remedial cementing can be used, for example, to supplement a faulty primary cement job, reduce or eliminate the flow of wellbore fluids (e.g., water or hydrocarbons), repair casing leaks, stop lost circulation in open hole, supplement primary cement around a liner, sealing a leakage of a liner top, or abandoning single wellbore zones. Squeeze cementing can include pumping cement slurry into a formation under pressure to seal off a void caused by fractures within the formation. The cement can also fill spaces behind the casing that were not properly filled during primary cementing, or perforations or splits in the casing that occur after a primary cement job. The wellbore assembly of the present disclosure can be used to perform multiple types of squeeze cementing (e.g., packer squeeze cementing, low pressure squeezing, or high pressure squeezing) while preventing a backflow of fluid through the cement retainer.

Particular implementations of the subject matter described in this specification can be implemented so as to realize one or more of the following advantages. For example, the cement retainer of the present disclosure prevent backflow of fluids during a remedial cementing operation. Additionally, the cement retainer of the present disclosure allows cement to be injected during a squeeze operation while preventing fluids from flowing uphole after the cement has been squeezed into the target zone. Additionally, the flapper valve assembly of the present disclosure can be retrofitted into an existing cement retainer.

Figure 1:
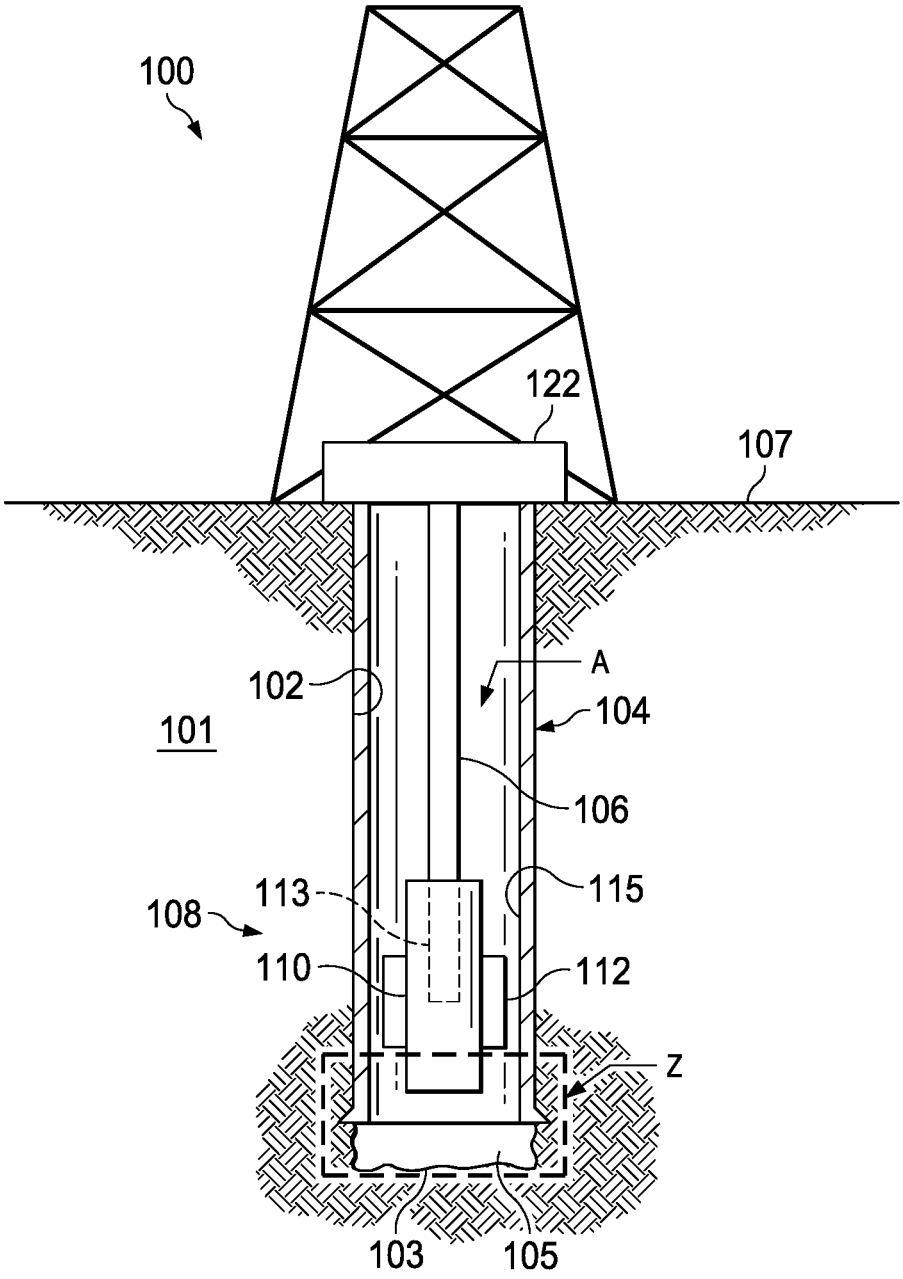
FIG. 1 is a schematic view, partially cross-sectional, of a wellbore assembly disposed within a wellbore during a remedial cement operation.

FIG. 1 shows a wellbore assembly 100 disposed within a wellbore 102 (e.g., a horizontal or non-vertical wellbore) formed in a geologic formation 101. The geologic formation 101 can include a hydrocarbon reservoir from which hydrocarbons can be extracted. The wellbore 102 extends from a surface 107 (e.g., a terranean surface) to a downhole end 103 of the wellbore 102. The wellbore 102 includes a casing 104 disposed within the wellbore 102 and extending from the surface 107. The casing 104 is cemented on the wellbore 102. The casing 104 can extend to the downhole end 103 of the wellbore 102 or can extend to a section uphole of the downhole end 103, leaving a section 105 of the wellbore 102 open hole.

The wellbore assembly 100 includes a wellbore or tubing string 106 (e.g., a work string) disposed within the wellbore 102. The wellbore string 106 flows fluid from or near the surface 107 of the wellbore to a target zone "Z" of the wellbore 102 at a downhole location of the wellbore 102. The wellbore string 106 can be attached to surface equipment 122 such as a rig that moves the wellbore string 106 along the wellbore 102. The wellbore string 106 is also fluidly coupled to a pump (not shown) such as a surface pump that flows fluid (e.g., cement slurry) from the surface 107 of the wellbore 102 to the target zone "Z."

The wellbore assembly 100 also includes a cement retainer 108 releasably coupled to the wellbore string 106. The cement retainer 108 resides at a downhole end or portion 113 of the wellbore string 106. The cement retainer 108 defines, with a wall 115 of the casing 104, an annulus "A." The wellbore string 106 lowers the cement retainer to the target zone "Z" to perform a remedial cementing operation.

The cement retainer 108 has a housing 110 and one or more packers 112 that, when set on the casing 104, isolate sections of the annulus "A." The packer 112 can be designed to be set mechanically. For example, the packer 112 can be set mechanically by first rotating the wellbore string 106 (e.g., clockwise rotation), and then applying overpull, activating the packer 112 to expand the packer 112.

Figure 2:
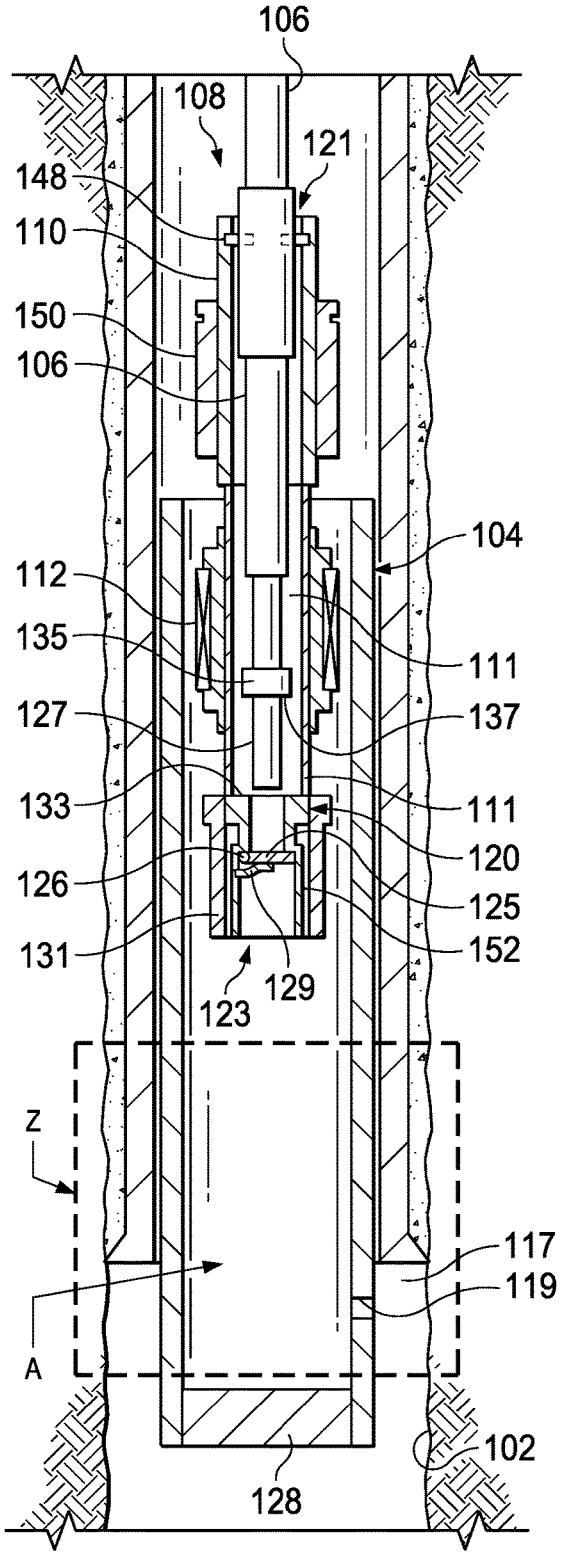
FIGS. 2-8 are front schematic views, partially cross-sectional, of sequential steps of performing a remedial cementing operation.

FIGS. 2-8 show sequential steps of performing a remedial cementing operation in the wellbore 102. As depicted in FIG. 2, the housing 110 of the cement retainer 108 is a tubular housing that can be made of multiple subs or tubes attached together. The housing 110 defines a bore 111 fluidly coupled to the wellbore string 106. The bore 111 can extend from a fluid inlet 121 to a fluid outlet 123 of the cement retainer 108. The cement retainer 108 defines a fluid pathway that extends along the bore 111 from the fluid inlet 121 to the fluid outlet 123. In some implementations, the bore 111 can have multiple inner diameters or the bore 111 can be made of multiple bores of respective housings or subs attached together.

The cement retainer 108 also includes a valve 120 (e.g., a flapper valve) attached to and disposed within the bore 111 of the housing 110. FIG. 2 shows the valve 120 in a closed position. In the closed position, the fluid pathway of the cement retainer 108 is closed by the flapper valve 120. The flapper valve 120 is a one-way valve, restricting fluid from flowing uphole (e.g., prevent backflow in the cement retainer 108) along the fluid pathway. As further described in detail below with respect to FIG. 5, the flapper valve 120 moves between the closed position and an opened position. In the open position, the flapper valve 120 opens the fluid pathway, allowing fluid to flow downhole along the fluid pathway past the flapper valve and out of the cement retainer 108.

The valve 120 can be spring-loaded. For example, the valve 120 can have a cap 125 that is attached to and pivotable or rotatable about a pivot 126. The valve 120 can have a spring 129 (e.g., a torsion spring) that biases the cap 125 about the pivot to the closed position. For example, the bore 111 can have an annular shoulder that stops the cap 125 to form a fluid-tight seal with the cap 125 when the cap 125 is in the closed position. The cap 125 can be pushed downhole by the wellbore string 106 to open the valve 120.

The wellbore string 106 is releasably attached to the cement retainer 108 by one or more collapsible fasteners 148. The fasteners 148 can be shear pins that are attached to and extend from the wellbore string 106 to the bore 111 of the cement retainer 108. The shear pins 148 break under a shear force applied, with the packer 112 set on the casing 104, by the wellbore string 106 pushing or applying weight downhole from the surface of the wellbore 102. For example, once the cement retainer 108 is set on the casing 104, the wellbore string 106 can be pushed downhole with respect to the cement retainer until the shear pins 148 break, releasing the wellbore string 106 from the cement retainer 108.

The wellbore string 106 has a stinger 127 that "stings" the cement retainer 108 to open the flapper valve 120. The stinger 127 is a tube of reduced outer diameter and resides at the end of the wellbore string 106. The stinger 127 extends from a wider tube and has a diameter smaller than an inner diameter of a flapper valve housing 131. The stinger 127 has a fixed ring 135 that can be attached to or integrally formed with the stinger 127. The ring defines an outwardly-projecting shoulder 137 that bears against an inner rim 133 or inwardly-projecting shoulder to form, with the rim 133, a no-go profile. For example, once the inner rim 133 stops or bears against the ring 135, the inner rim 133 stops the stinger from moving further downhole, preventing the wellbore string 106 from damaging the flapper valve 120. For example, the no-go profile can help prevent a wide section of the wellbore string 106 from pushing and damaging the valve 120 or the valve housing 131. Additionally, the no-go profile helps prevent the stinger from passing excessively through the flapper valve, thereby preventing damage of the flapper valve assembly. Additionally, the no-go profile can indicate that the stinger has reached the desired depth and that the valve is now fully opened.

The housing 110 of the cement retainer can be made of multiple tubular housings or subs. For example, the housing 110 has a main tubular housing 150 and the flapper valve housing 131 attached to a downhole end of the main tubular housing 150. The main tubular housing 150 can include the bore 111 and the flapper valve housing can define a second, smaller bore 152 fluidly connected to the main bore 111. For example, the bore of the flapper valve housing 131 can have a diameter that is less than a diameter of the bore 111 of the tubular housing 150. The flapper valve 120 resides inside the flapper valve housing 131. The flapper valve housing 131 can be threadedly coupled to a downhole end of the tubular housing 150. Thus, the flapper valve housing 131 can be used to retrofit an existing cement retainer to add the flapper valve assembly to an existing cement retainer.

The target zone "Z" can be a downhole area of the wellbore 102 that is damaged or otherwise needs remedial cementing. Specifically, the cement retainer 108 is used for remedial cementing operations, where the target zone "Z" includes at least one of a damaged section of the casing 104, a perforated section of the casing 104, an open hole section of the wellbore 102, or a defective cement layer of the wellbore 102. For example, the casing 104 can have an aperture 119 that connects the interior of the casing 104 to an empty space of the wellbore annulus 117. The wellbore string 106 can squeeze cement through the aperture 119 into the wellbore annulus 117 to fill in a defective cement layer. In some implementations, the wellbore string 106 can inject cement into an open hole section of the wellbore out of a last casing pipe 124 or liner In some implementations, the wellbore string 106 can squeeze cement into a formation through apertures of the casing to abandon the formation. The casing 104 can be a progressive casing made of multiple pipes of progressively smaller diameter. The wellbore string 106 can squeeze cement into one or more pipes of the casing and into one or more sections of the annulus 117 of the wellbore.

In some implementations, the wellbore string 106 can squeeze cement into a portion of the casing uphole of a plug 128 (e.g., a second packer) to form a cement plug in the casing (and optionally in the annulus of the wellbore). For example, the target zone can include an isolated section defined between the wellbore plug 128 downhole of the cement retainer 108 and the packer 112 set on the casing 104. The wellbore string 106 flows or directs cement into the isolated section.

The packer 112 is attached to the housing 110 and is arranged to expand and form a fluid-tight seal with the casing 104. In some implementations, the packer 112 can be set by fluidly pressurizing the cement retainer 108. For example, the wellbore string 106 can flow fluid from the surface of the wellbore 102 to the bore 111 of the cement retainer 108 to activate, by fluidly pressurizing the bore 111, the packer 112. In some implementations, the packer 112 can be mechanically or electrically set on the casing 104. For example, the packer 112 can be set by some form of tubing movement, such as rotation or upward/downward motion of the wellbore string 106.

Figure 3:
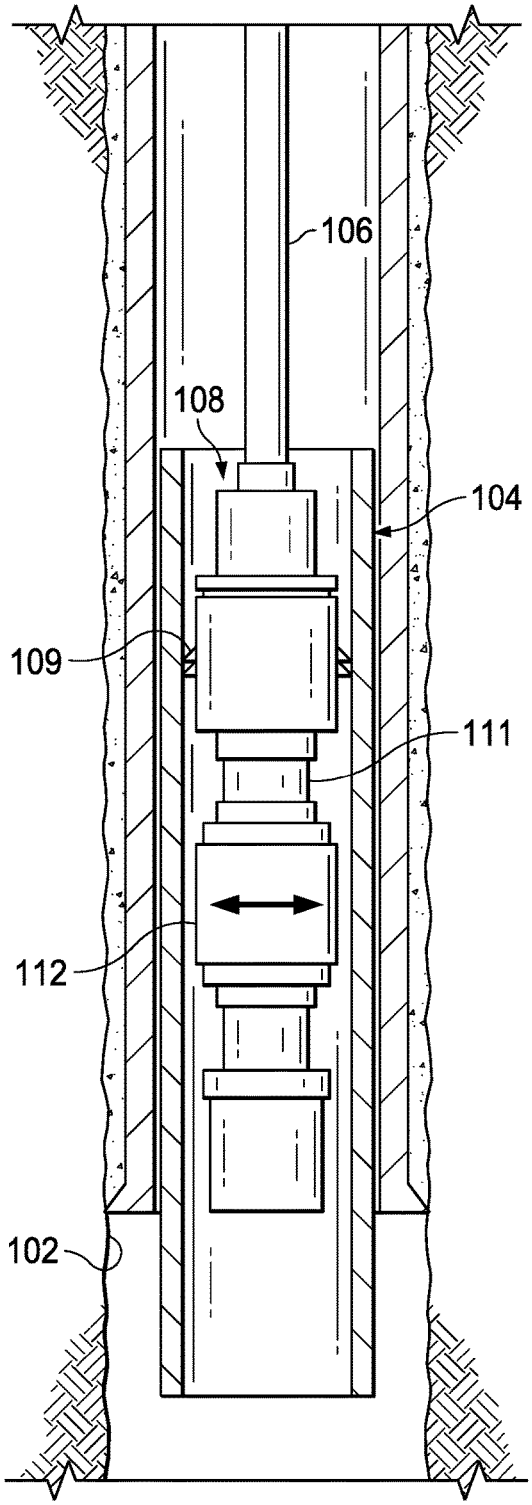

Referring also to FIG. 3, the cement retainer 108 can have movable slips or teeth 109 to help set the cement retainer 108 on the wellbore 102. To set the cement retainer 108, the wellbore string 106 can first lower the cement retainer 108 to the target zone "Z." Then, the wellbore string 106 can hydraulically or mechanically (or otherwise) set the slips 109 and the packer 112 on the wall of the casing 104 such that the packer 112 is disposed uphole of the target zone "Z." The flapper valve 120 remains closed during setting of the packer 112 and the slips 109.

Figure 4:
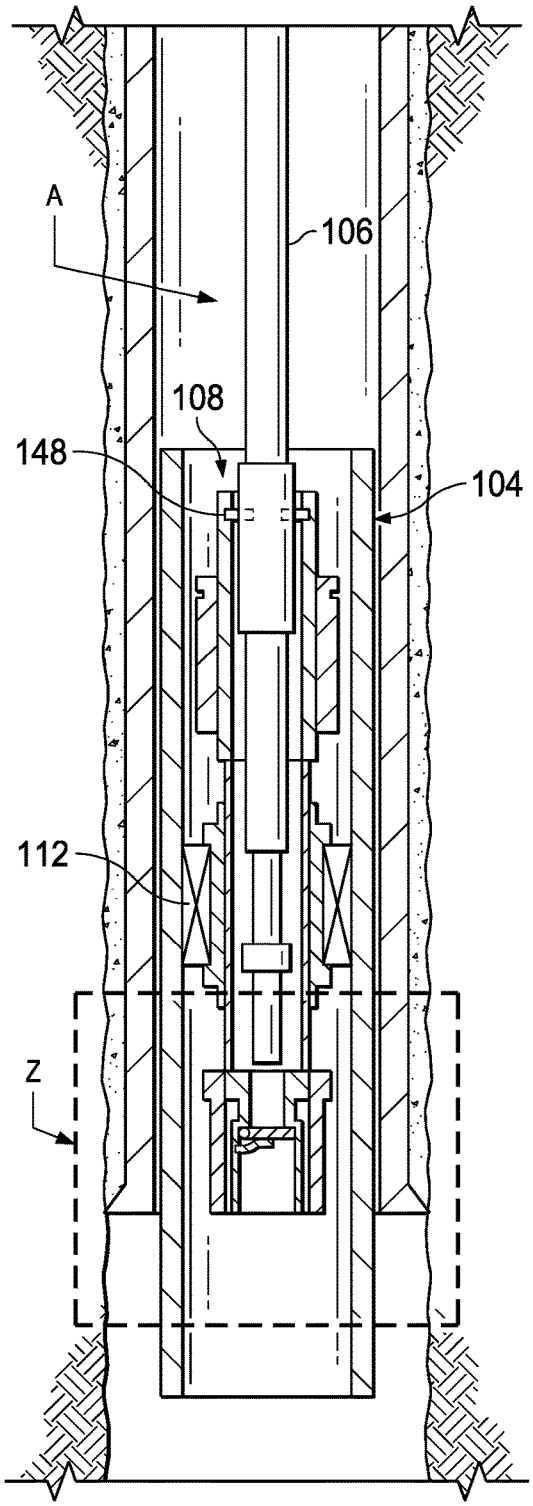

As illustrated in FIG. 4, the cement retainer 108 fluidly isolates, with the packer 112 set on the wellbore, a first section of the annulus "A" uphole of the packer from a second section of the annulus "A" at the target zone "Z" and downhole of the packer 112. With the packer 112 set on the casing 104, the wellbore string 106 is pushed downhole to break the pins 148.

Figure 5:
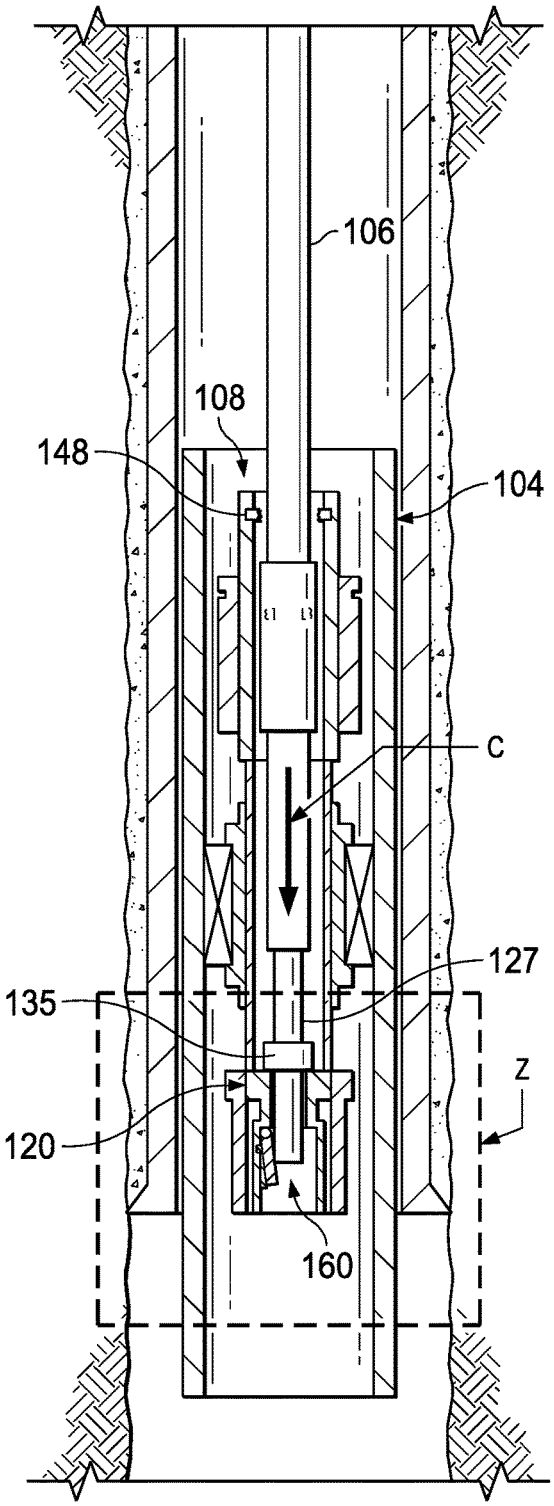

As shown in FIG. 5, the wellbore string 106 is pushed downhole until the shear off pins 148 collapse and the wellbore string 106 is free to move with respect to the cement retainer 108. With the wellbore string 106 detached from the cement retainer 108, the stinger 127 of the wellbore string 106 opens the flapper valve 120 by stinging or pushing the flapper valve 120 open. The wellbore string 106 maintains the flapper valve 120 open to pump or squeeze cement "C" from the string 106 and into the target zone "Z."

As shown, the ring 135 of the stinger 127 is disposed at a distance from a downhole fluid outlet 160 of the stinger 127 such that, with the stinger stinging the flapper valve to maintain the valve 120 open, the ring 135 bears against the inner rim and the downhole fluid outlet 160 extends a distance (e.g., a short distance) downhole from the pivot 126 of the flapper valve 120.

Figure 6:
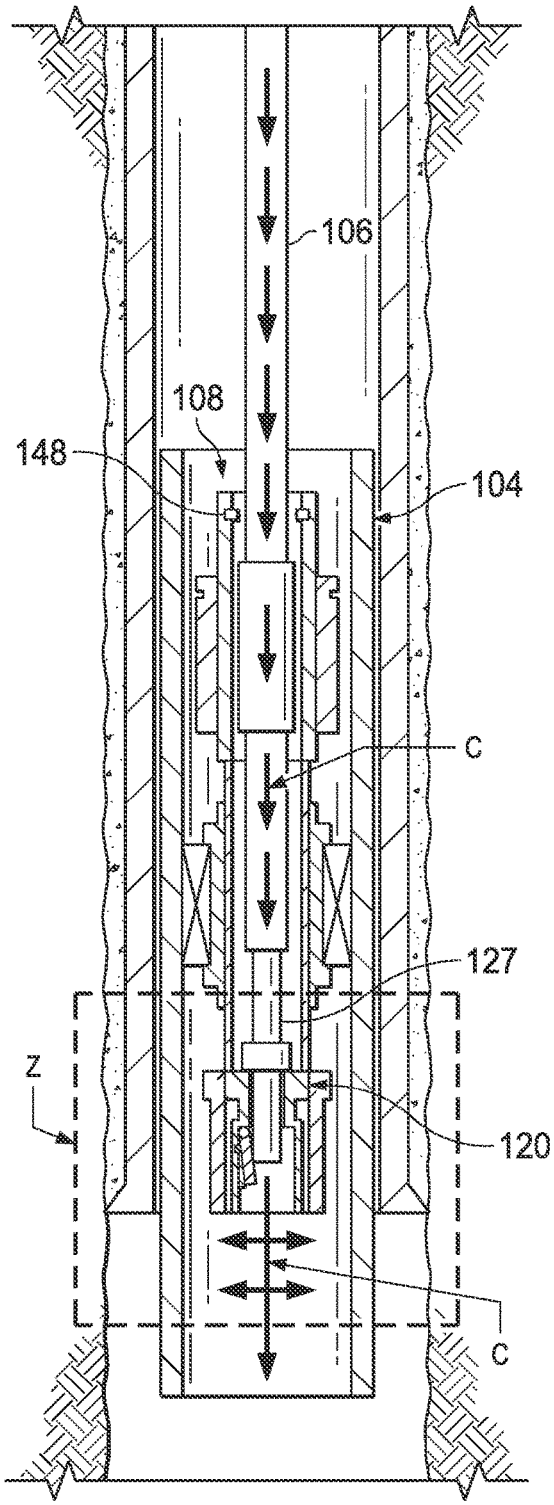

Referring to FIG. 6, with the flapper valve 120 opened, the wellbore string 106 flows cement "C" to the target zone "Z". During flowing of the cement "C," the stinger 127 maintains the flapper valve 120 opened. As described above with respect to FIG. 1, the cement pump flowing the cement can pressurize the cement "C" until the cement squeezes through apertures of the casing to cement an annulus of the wellbore.

After the cement slurry has been squeezed into the target zone, the wellbore string 106 can be retrieved from the wellbore, leaving the cement retainer 108 set on the wellbore during curing of the cement. The cement retainer 108 can be drillable such that a drill string drills through the cement retainer to continue to drill downhole of the cement retainer 108.

Figure 7:
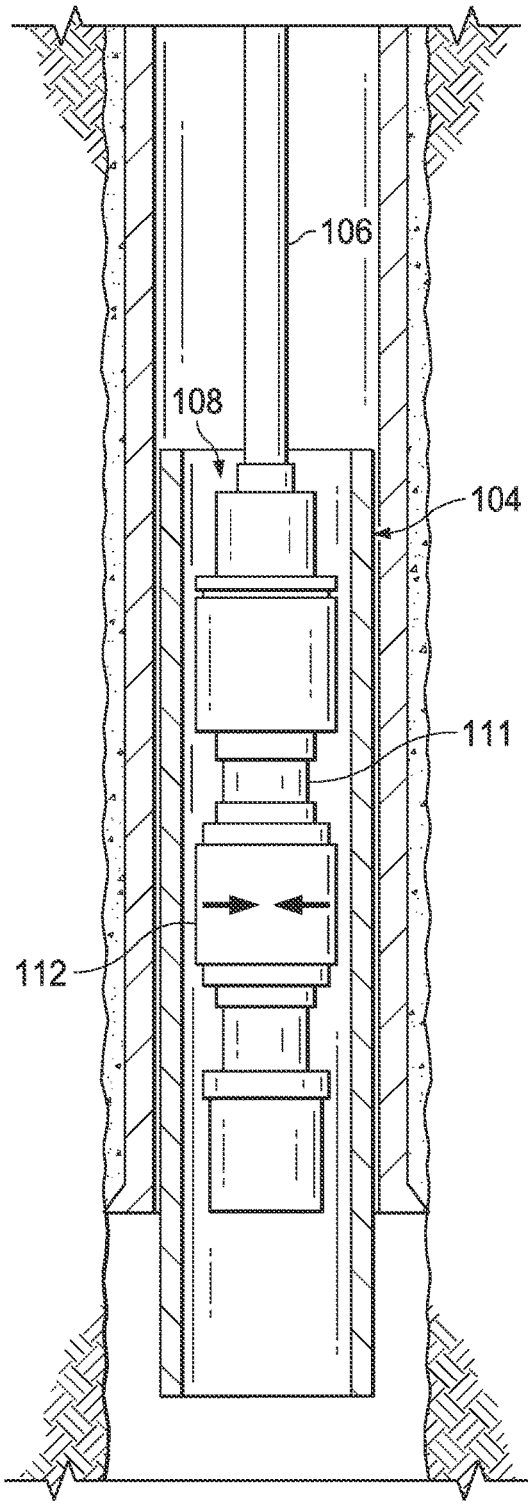
Figure 8:
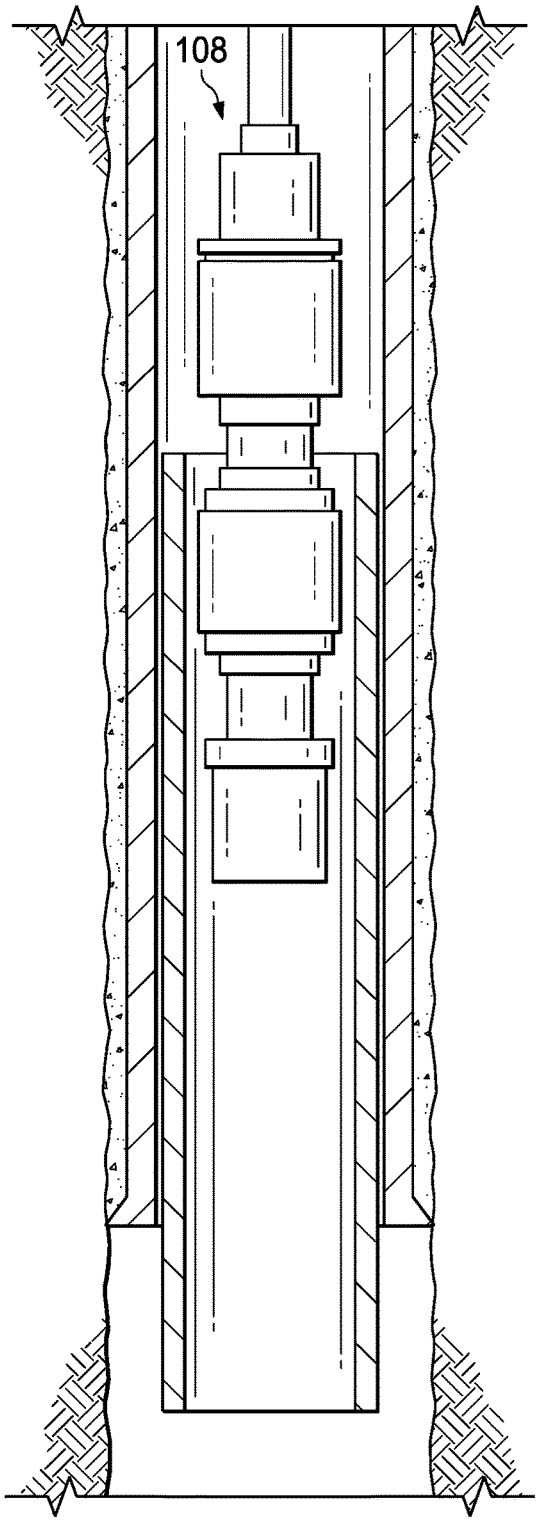

As shown in FIGS. 7 and 8, in some implementations, the cement retainer 108 can be retrieved from the wellbore after the cementing operation is finished. For example, the wellbore string 106 can unset the packer 112 by engaging the cement retainer 108 and pulling the cement retainer uphole. For example, the ring or another part of the wellbore string 106 can engage an inwardly projecting shoulder or rim of the cement retainer 108 to engage and retrieve the cement retainer 108 from the wellbore.

Figure 9:
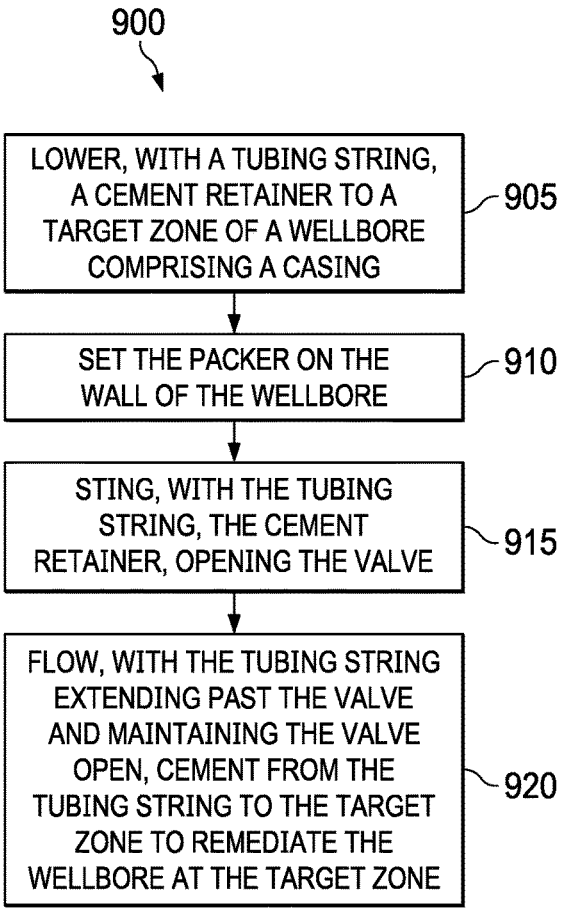
FIG. 9 is a flow chart of a remedial cementing method according to implementations of the present disclosure.

FIG. 9 shows a flow chart of an example method 900 of remediating a wellbore. The method includes lowering, with a tubing string, a cement retainer to a target zone of a wellbore that includes a casing. The cement retainer is releasably and fluidly coupled to a downhole section of the wellbore string. The cement retainer has a bore defining a fluid pathway extending from a fluid inlet of the cement retainer to a fluid outlet of the cement retainer. The wellbore defines, between an external surface of the cement retainer and a wall of the casing, an annulus. The cement retainer includes: i) a valve residing at the bore and configured to restrict fluid from flowing uphole along the fluid pathway, the valve pivotable between a closed position, in which the valve blocks the fluid pathway, and an opened position, in which the fluid pathway is opened and the valve allows fluid to flow downhole along the fluid pathway, and ii) a packer configured to isolate, with the packer set on the wall of the casing, a first section of the annulus uphole of the packer from the target zone of the wellbore, the target zone of the wellbore downhole of the packer (905). The method also includes setting the packer on the wall of the wellbore (910). The method also includes stinging, with the tubing string, the cement retainer, opening the valve (915). The method also includes flowing, with the tubing string extending past the valve and maintaining the valve open, cement from the tubing string to the target zone to remediate the wellbore at the target zone (920).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly, comprising:

a wellbore string configured to be disposed within a wellbore comprising a casing, the wellbore string configured to flow fluid from or near a terranean surface of the wellbore to a target zone of the wellbore at a downhole location of the wellbore; and a cement retainer releasably coupled to the wellbore string and residing at a downhole end of the wellbore string, the cement retainer defining, with a wall of the casing, an annulus, the cement retainer comprising:

a housing defining a bore fluidly coupled to the wellbore string;

a flapper valve attached to and disposed within the bore of the housing, the flapper valve configured to move between a closed position, in which a fluid pathway of the cement retainer is closed by the flapper valve, and an opened position, in which the fluid pathway is opened by the flapper valve, allowing fluid to flow downhole past the flapper valve and out of the cement retainer; and a packer attached to the housing, the packer configured to fluidly isolate, with the packer set on the casing, a first section of the annulus uphole of the packer from a second section of the annulus at the target zone and downhole of the packer;

wherein the wellbore string is configured to set, with the flapper valve closed and the wellbore string attached to the cement retainer, the packer on the casing, and the wellbore string is configured to open, with the packer set on the casing and the wellbore string detached from the cement retainer, the flapper valve by stinging the flapper valve, allowing cement to flow downhole from the wellbore string to the target zone to remediate the wellbore at the target zone.

2. The wellbore assembly of claim 1, wherein the wellbore string comprises a ring fixed to the wellbore string and defining, with an inner rim of the cement retainer, a no-go profile, the inner rim configured to bear against and prevent the ring from moving downhole past the inner rim.

3. The wellbore assembly of claim 2, wherein the housing comprises a tubular housing defining the bore and a flapper valve housing threadedly coupled to a downhole end of the tubular housing, the flapper valve housing defining a second bore defining a diameter less than a diameter of the bore of the tubular housing, the flapper valve residing inside the flapper valve housing, the flapper valve housing defining the inner rim and a fluid outlet of the housing.

4. The wellbore assembly of claim 3, wherein the ring is disposed at a distance from a downhole fluid outlet of the wellbore string such that, with the wellbore string stings the flapper valve, the ring bears against the inner rim and the downhole fluid outlet extends a distance downhole from a pivot of the flapper valve and the flapper valve fully opened.

5. The wellbore assembly of claim 1, wherein the wellbore assembly is configured to perform a remedial cement squeeze operation and the target zone comprises at least one of a damaged section of the casing, a perforated section of the casing, an open hole section of the wellbore, or a defective cement layer of the casing.

6. The wellbore assembly of claim 5, wherein the target zone comprises a section defined between a wellbore plug downhole of the cement retainer and the packer set on the casing, and the wellbore string is configured to flow fluid into the section and squeeze, under fluidic pressure, cement out of the casing through an aperture of the casing into a second annulus defined between the casing and a wall of the wellbore.

7. The wellbore assembly of claim 1, wherein the wellbore string is configured to mechanically set, with the flapper valve closed and the wellbore string attached to the cement retainer, the packer on the wellbore.

8. The wellbore assembly of claim 1, wherein the flapper valve comprises a spring configured to bias the flapper valve to the closed position to restrict fluid from flowing uphole along the fluid pathway.

9. The wellbore assembly of claim 1, wherein the cement retainer is releasably coupled to the wellbore string by one or more shear pins extending from the wellbore string to the bore of the cement retainer, the shear pins configured to collapse under a shear force applied, with the packer set on the casing, by the wellbore string pushed downhole from the terranean surface of the wellbore.

10. The wellbore assembly of claim 1, wherein the packer is configured to retract from the casing, and the wellbore string is configured to engage, after cement has been flown to the target zone, the cement retainer to pull, with the packer unset from the casing, the cement retainer out of the wellbore.

11. The wellbore assembly of claim 1, wherein the cement retainer is drillable by a drill string, the packer configured to remain set on the casing during curing of the cement.

12. A cement retainer comprising:

a housing releasably coupled to and residing at a downhole end of a wellbore string configured to be disposed within a wellbore comprising a casing, the housing defining a bore fluidly coupled to the wellbore string and defining a fluid pathway extending from a fluid inlet of the cement retainer to a fluid outlet of the cement retainer, the wellbore defining, between an external surface of the housing and a wall of the casing, an annulus;

a valve attached to and residing inside the housing and configured to restrict fluid from flowing uphole along the fluid pathway, the valve pivotable about a pivot and comprising a spring configured to bias the valve about the pivot to a closed position, in which the valve blocks the fluid pathway and prevents fluid from flowing downhole along the fluid pathway, the valve movable to an opened position, in which the fluid pathway is opened and the valve allows fluid to flow downhole along the fluid pathway; and a packer attached to the housing, the packer configured to isolate, with the packer set on the wall of the casing, a first section of the annulus uphole of the packer from a target zone of the wellbore downhole of the packer, wherein the valve is configured to be opened, with the packer set on the casing, by the wellbore string stinging the valve, allowing cement to flow from the wellbore string to the target zone to remediate the wellbore at the target zone.

13. The cement retainer of claim 12, wherein the cement retainer is configured to perform a remedial cement squeeze operation and the target zone comprises at least one of a damaged section of the casing, a perforated section of the casing, an open hole section of the wellbore, or a defective cement layer of the casing.

14. The cement retainer of claim 13, wherein the target zone comprises a section defined between a bottom hole end of the wellbore or a wellbore plug and the packer, and the wellbore string is configured to flow fluid into the section and squeeze, under fluidic pressure, cement out of the casing through an aperture of the casing into a second annulus defined between the casing and a wall of the wellbore.

15. The cement retainer of claim 12, wherein the housing is releasably coupled to the wellbore string by one or more shear pins extending from the wellbore string to the bore of the housing, the one or more shear pins configured to collapse under a shear force applied, with the packer set on the casing, by the wellbore string pushed downhole with respect to the cement retainer.

16. The cement retainer of claim 12, wherein the wellbore string comprises an outwardly-projecting shoulder fixed to the wellbore string and defining, with an inner rim of the cement retainer, a no-go profile, the inner rim configured to bear against and prevent the outwardly-projecting shoulder from moving downhole past the inner rim.

17. The cement retainer of claim 16, wherein the housing comprises a tubular housing defining the bore and a flapper valve housing attached to a downhole end of the tubular housing, the flapper valve housing defining a second bore defining a diameter less than a diameter of the bore, the flapper valve residing inside the flapper valve housing and the flapper valve housing defining the inner rim of the cement retainer.

18. The cement retainer of claim 17, wherein the outwardly-projecting shoulder is disposed at a distance from a downhole fluid outlet of the wellbore string such that, during stinging of the flapper valve, the outwardly-projecting shoulder bears against the inner rim and the downhole fluid outlet extends a distance downhole from the pivot of the flapper valve with the flapper valve fully opened.

19. A method of performing a remedial cementing operation, the method comprising:

lowering, with a tubing string, a cement retainer to a target zone of a wellbore comprising a casing, the cement retainer releasably and fluidly coupled to a downhole section of the wellbore string, the cement retainer comprising a bore defining a fluid pathway extending from a fluid inlet of the cement retainer to a fluid outlet of the cement retainer, the wellbore defining, between an external surface of the cement retainer and a wall of the casing, an annulus, the cement retainer comprising i) a valve residing at the bore and configured to restrict fluid from flowing uphole along the fluid pathway, the valve pivotable between a closed position, in which the valve blocks the fluid pathway, and an opened position, in which the fluid pathway is opened and the valve allows fluid to flow downhole along the fluid pathway, and ii) a packer configured to isolate, with the packer set on the wall of the casing, a first section of the annulus uphole of the packer from the target zone of the wellbore, the target zone of the wellbore downhole of the packer;

setting the packer on the wall of the casing;

stinging, with the tubing string, the cement retainer, opening the valve; and flowing, with the tubing string extending past the valve and maintaining the valve open, cement from the tubing string to the target zone to remediate the wellbore at the target zone.

20. The method of claim 19, further comprising:

retrieving the tubing string; and after the cement has cured, drilling the cement retainer and continuing to drill past the cement retainer through the cured cement.

* * * * *